US006574988B1

(12) United States Patent
Saulnier et al.

(10) Patent No.: US 6,574,988 B1
(45) Date of Patent: Jun. 10, 2003

(54) PROCESS AND PLANT FOR PRODUCING ARGON BY CRYOGENIC DISTILLATION

(75) Inventors: Bernard Saulnier, Colombes (FR); Jean-Pierre Gourbier, La Plessis Trevise (FR)

(73) Assignee: L'Air Liquide Societe Anonyme a Directoire et Conseil de Surveillance pour l'Etude et l'Exploitation des Procedes Georges Claude, Paris Cedex (FR)

( * ) Notice: Subject to any disclaimer, the term of this patent is extended or adjusted under 35 U.S.C. 154(b) by 0 days.

(21) Appl. No.: 09/937,821

(22) PCT Filed: Mar. 27, 2000

(86) PCT No.: PCT/FR00/00763

§ 371 (c)(1),
(2), (4) Date: Sep. 28, 2001

(87) PCT Pub. No.: WO00/58675

PCT Pub. Date: Oct. 5, 2000

(30) Foreign Application Priority Data

Mar. 29, 1999 (FR) ..... 99 03870

(51) Int. Cl.[7] ..... F25J 3/00
(52) U.S. Cl. ..... 62/648; 62/924

(58) Field of Search ..... 62/648, 924, 643, 62/646

(56) References Cited

U.S. PATENT DOCUMENTS

| | | | | |
|---|---|---|---|---|
| 5,076,823 A | * | 12/1991 | Hansel et al. | 62/651 |
| 5,133,790 A | | 7/1992 | Bianchi et al. | |
| 5,207,066 A | * | 5/1993 | Bova et al. | 62/645 |
| 5,440,884 A | | 8/1995 | Bonaquist et al. | |
| 5,809,802 A | * | 9/1998 | Rathbone | 62/646 |
| 5,970,743 A | * | 10/1999 | Herron et al. | 62/648 |
| 6,269,659 B1 | * | 8/2001 | De Bussy et al. | 62/648 |

FOREIGN PATENT DOCUMENTS

| | | |
|---|---|---|
| DE | 821 654 | 10/1951 |
| DE | 930 033 | 11/1954 |
| EP | 0 538 520 | 4/1993 |
| EP | 0 669 509 | 8/1995 |
| EP | 0 786 633 | 7/1997 |

* cited by examiner

*Primary Examiner*—William C. Doerrler
(74) *Attorney, Agent, or Firm*—Young & Thompson

(57) ABSTRACT

In a process for separating argon-enriched gas, the gas is purified of oxygen in a first column (1) and then a stream (15) removed from the top of the first column is sent into a stripping column (2). The product (21) is withdrawn as bottoms therefrom.

7 Claims, 2 Drawing Sheets

PROCESS AND PLANT FOR PRODUCING ARGON BY CRYOGENIC DISTILLATION

BACKGROUND OF THE INVENTION

The present invention relates to a process and to a plant for producing argon by cryogenic distillation.

Usually, an argon-enriched stream is withdrawn from the low-pressure column of a double air-separation column and sent to the bottom of a first column so as to decrease as much as necessary the amount of argon contained in the oxygen produced.

In the conventional process, the argon produced by this first column is withdrawn from the top and it essentially contains the nitrogen introduced in the feed.

It is therefore common practice, as may be seen in EP-A-0 669 509 and EP-A-0669508, to send it into a second column called a denitrogenating column comprising a stripping section intended to remove the nitrogen from the argon produced at the bottom, a rectifying section intended to remove the argon from the waste nitrogen withdrawn from the top, a bottom reboiler and an overhead condenser.

U.S. Pat. No. 5,133,790 describes a system in which enough distillation trays are fitted in the low-pressure column, above the point where feed is withdrawn from the first column, in order to lower the nitrogen content in proportions such that the argon produced has a "commercial" argon content, generally 1 ppm. Thus, the denitrogenating column may be omitted. It is therefore useful to have several distillation trays above the point of withdrawal of the argon-rich fluid from the first column and to provide a purge at the top of the first column so as to remove a portion of the nitrogen introduced. Under these conditions, the nitrogen content of the argon produced may be approximately three times less than that of the column feed.

The drawback of this process is that it is essential to be able to control the operation of the low-pressure column so that the nitrogen content at the point of withdrawal of the feed intended for the first column never exceeds the permissible amount, unless the column has enough trays to have at the nominal point a sufficient margin with respect to this limit.

U.S. Pat. Nos. 4,977,746 and 4,824,453 disclose a process for producing ultrapure oxygen and argon in which a liquid withdrawn at an intermediate level of the argon production column feeds the top of a stripping column at the bottom of which the ultrapure oxygen forms.

SUMMARY OF THE INVENTION

It is an object of the invention to provide a process for separating an argon-enriched gas by cryogenic distillation, comprising the following steps:

the step of sending an argon-enriched gas stream to a first column;

the step of separating the gas by distillation in the first column into an oxygen-enriched liquid and an argon-enriched gas;

the step of at least partially condensing the argon-rich gas in an overhead condenser of the first column in order to form reflux;

the step of removing another argon-rich stream containing at most 1000 ppm oxygen and 1000 ppm nitrogen from the first column and of sending it to the top of a second column;

the step of warming the bottom of the second column by means of a warming gas; and the step of withdrawing, as final product, an argon-rich fluid from the lower portion of the second column.

The stream sent to the top of the second column may be a gas or a liquid.

Preferably, the warming gas is a fraction of the argon-enriched gas which feeds the first column.

In certain cases, the first column is in two sections, one section being fed with the argon-enriched gas and the other having the overhead condenser.

Normally, the first column is fed from the low-pressure column of a double column.

Preferably, an overhead gas of the second column is sent either to the top of the first column or to the overhead condenser of the first column.

It is another object of the invention to provide a plant for separating an argon-enriched gas by cryogenic distillation, comprising:

a first column having an overhead condenser;

a second column having a bottom reboiler;

means for sending an argon-enriched gas to a first level of the first column;

means for withdrawing an argon-rich fluid at a second level of the first column;

means for sending the argon-rich fluid to the top of the second column;

means for sending a warming gas to the bottom reboiler;

means for withdrawing an argon-rich final product from the bottom of the second column, characterized in that, between the first and second levels, there are at least 100 theoretical trays.

The argon-rich fluid sent to the top of the second column may be a gas or a liquid.

Preferably, the plant comprises means for sending a portion of the argon-enriched gas to the bottom reboiler as warming gas.

Optionally, the first column is constructed in two sections. Preferably, the plant comprises means for sending an overhead gas from the second column either to the top of the first column or to the overhead condenser of the first column.

BRIEF DESCRIPTION OF THE DRAWINGS

The invention will now be described in greater detail with reference to

DETAILED DESCRIPTION OF THE PREFERRED EMBODIMENTS

Figure 1:
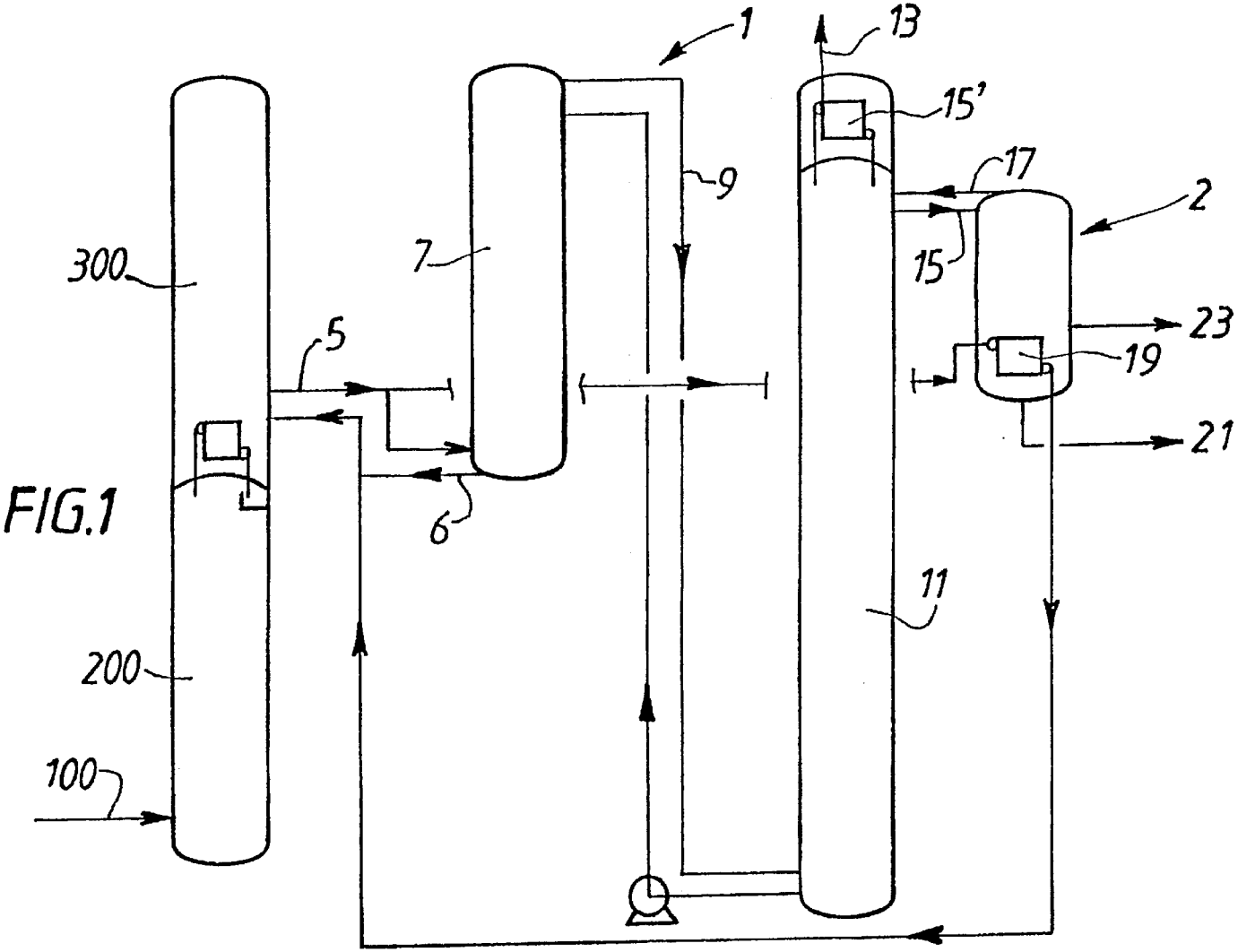
FIGS. 1 and 2, which show plants according to the invention.

In FIG. 1, an air stream 100 is sent to a conventional double air-separation column comprising a medium-pressure column 200 thermally coupled to a low-pressure column 300.

Some of the details of this column have been omitted in order to make the presentation of the invention easier.

An argon-enriched stream 5, containing 7% argon and a few ppm nitrogen and oxygen, removed from the low-pressure column 300 is sent to the bottom of the first section 7 of the first column 1. A liquid stream 6 is sent back from the bottom of the column first column to the low-pressure column.

The first section 7 containing structured packings of the crossed corrugated type is used to separate the argon-enriched stream.

An overhead gas 9 of the first section is sent to the bottom of the second section 11 and a bottom liquid from the second section is sent to the top of the first section 7 in order to serve as reflux.

The overhead gas of the first column (mixing column) is at least partially condensed in an overhead condenser 15' against the rich liquid from the bottom of the medium-pressure column or another fluid. An uncondensed argon-rich gas purge 13 may also be removed. As it cannot be rich in nitrogen for temperature reasons, the argon loss will be proportional to the amount of nitrogen introduced into the first section 7.

Nevertheless, this may be five to ten times greater than the permissible content in the case of U.S. Pat. No. 5,133,790, for a loss of less than 5%.

An argon-rich liquid stream 15 containing argon and at most 1000 ppm nitrogen and 1000 ppm oxygen is removed a few theoretical trays below the overhead condenser, for example three theoretical trays below.

The liquid 15 is sent to the top of the second column 2 in which it becomes enriched with argon. The nitrogen-enriched overhead gas 17 is sent back to the second section 11 of the first column. Preferably, there is no separating means nor reboiler above the point of introduction of the liquid 15 and no overhead condenser of the second column 2.

A portion of the argon-enriched gas serves to warm the bottom reboiler 19 of the column 2 and the stream thus condensed is mixed with the bottom liquid 6 of the first section and sent back to the low-pressure column 300. Any fluid warm enough for it to condense or cool at a temperature above the bottom liquid of the column 2 may serve to provide boil-up.

A liquid 21 or an argon-rich gas 23 is withdrawn from the bottom of the second column 2.

The argon-enriched gas may come at least partially from an apparatus other than the double column 200, 300. For example, it maybe transported by a truck or via a gas pipeline from a more distant apparatus.

Figure 2:
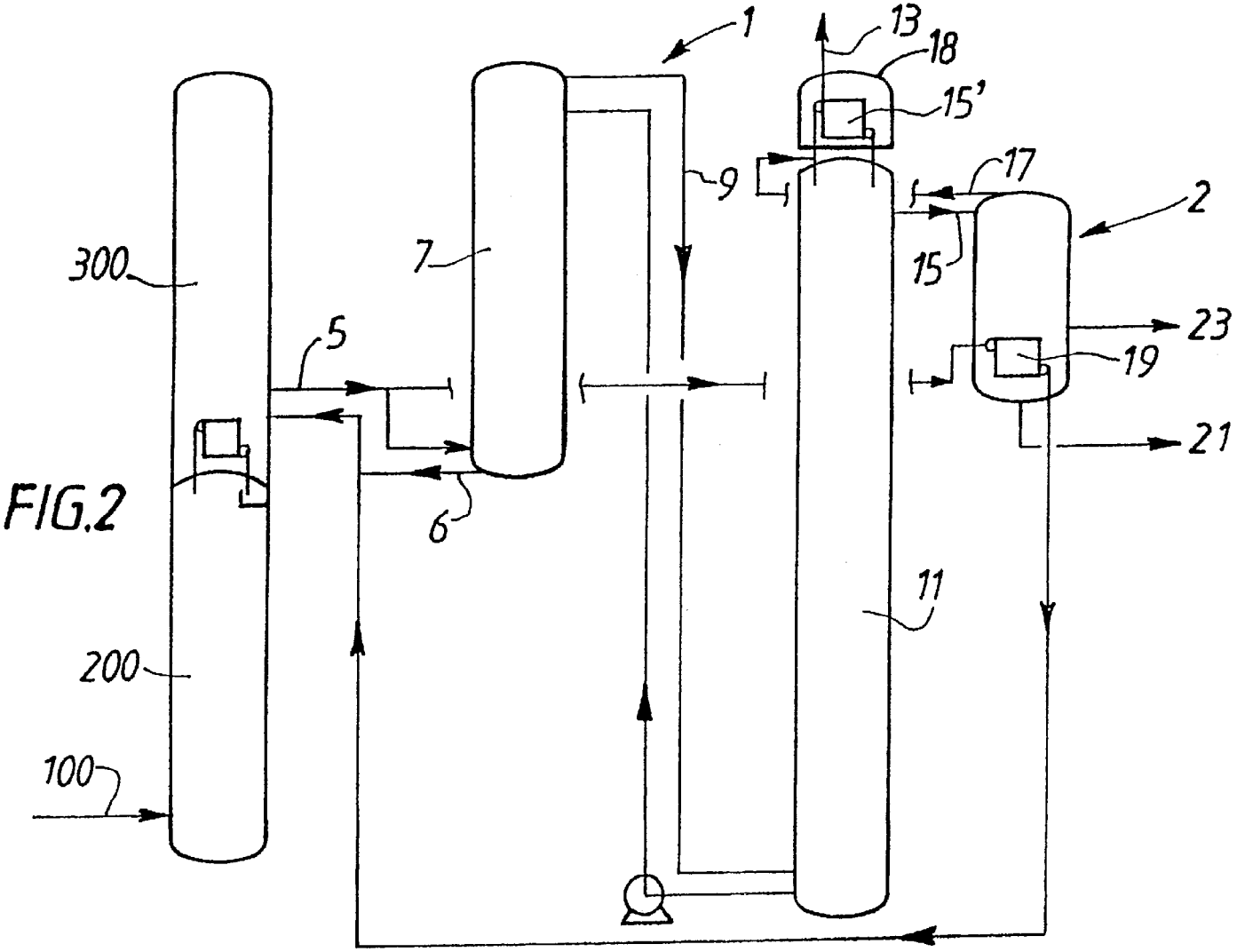

In the second figure, the columns 200, 300 and 7 are identical to those in FIG. 1. On the other hand, instead of sending the overhead gas from the second column directly back to the top of the column 11, it is preferable to send this stream directly to the overhead condenser 15' above this column 11. In the case of FIG. 2, the overhead gas of the column 11 is withdrawn therefrom, mixed with the overhead gas of the column 2 and sent to the tank 18 which contains the condenser 15'. The gas mixture at least partially condenses in this condenser before it is sent back in liquid form to the top of the column 11.

This system makes it possible to avoid the complexity consisting in creating an additional feed in the first column 11, without significantly affecting the argon production. This manner of implementing the invention is particularly profitable when the argon condenser and its tank are separated from the first column.

Preferably, the process does not use catalysis to purify the argon.

What is claimed is:

1. Process for separating an argon-enriched gas by cryogenic distillation, comprising the following steps:

the step of sending an argon-enriched gas stream to a first column;

the step of separating the gas by distillation in the first column into an oxygen-enriched liquid and an argon-enriched gas;

the step of at least partially condensing the argon-rich gas in an overhead condenser of the first column in order to form reflux;

the step of removing another argon-rich stream containing at most 1000 ppm oxygen and 1000 ppm nitrogen from the first column and of sending it to the top of a second column;

the step of warming the bottom of the second column by means of a warming gas;

the step of withdrawing, as a final product, an argon-rich fluid from the lower portion of the second column; and the step of sending an overhead gas of the second column to the overhead condenser of the first column.

2. Process according to claim 1, in which the warming gas is a fraction of the argon-enriched gas (5) which feeds the first column.

3. Process according to claim 1, in which the first column (1) is in two sections, one section (7) being fed with the argon-enriched gas and the other (11) having the overhead condenser.

4. Process according to claim 1, in which the first column is fed from the low-pressure column (300) of a double column.

5. Plant for separating an argon-enriched gas by cryogenic distillation, comprising:

a first column having an overhead condenser;

a second column having a bottom reboiler;

means for sending an argon-enriched gas to a first level of the first column;

means for withdrawing an argon-rich fluid at a second level of the first column;

means for sending the argon-rich fluid to the top of the second column;

means for sending a warming gas to the bottom reboiler;

means for withdrawing an argon-rich final product from the bottom of the second column; and means for sending an overhead gas from the second column to the overhead condenser of the first column wherein between the first and second levels, there are at least 100 theoretical trays.

6. Plant according to claim 5, comprising means for sending a portion of the argon-enriched gas (5) to the bottom reboiler (15') as warming gas.

7. Plant according to claim 5 in which the first column is constructed in two sections.

* * * * *